US005440279A

United States Patent [19]

Kinoshita et al.

[11] Patent Number: 5,440,279

[45] Date of Patent: Aug. 8, 1995

[54] ELECTROMAGNETIC RADIATION CONVERTER

[75] Inventors: Akira Kinoshita, Osaka; Yukiro Kashima, Takatsuki, both of Japan

[73] Assignee: Matsushita Electric Industrial Co., Ltd., Osaka, Japan

[21] Appl. No.: 156,819

[22] Filed: Nov. 24, 1993

[30] Foreign Application Priority Data

Nov. 24, 1992 [JP] Japan ..... 4-313064

[51] Int. Cl.[6] ..... H01P 5/07

[52] U.S. Cl. ..... 333/26; 333/21 A; 333/128; 343/756

[58] Field of Search ..... 333/21 A, 26; 343/756, 343/786

[56] References Cited

U.S. PATENT DOCUMENTS

| | | | |
|---|---|---|---|
| 2,979,679 | 4/1961 | Ellis | 333/21 A X |
| 4,679,249 | 7/1987 | Tanaka et al. | 333/26 X |
| 5,043,683 | 8/1991 | Howard | 333/21 A |
| 5,276,410 | 1/1994 | Fukuzawa et al. | 333/21 A |

FOREIGN PATENT DOCUMENTS

| | | | |
|---|---|---|---|
| 0470786 | 2/1992 | European Pat. Off. . | |
| 0523770 | 1/1993 | European Pat. Off. . | |
| 0542615 | 5/1993 | European Pat. Off. . | |
| 206301 | 9/1986 | Japan | 333/21 A |
| 62-107528 | 5/1987 | Japan . | |
| 19801 | 1/1989 | Japan | 333/21 A |
| 151801 | 6/1989 | Japan | 333/21 A |
| 3-185901 | 8/1991 | Japan . | |
| 35201 | 2/1992 | Japan | 333/21 A |
| 4172701 | 6/1992 | Japan . | |
| 256201 | 9/1992 | Japan | 333/21 A |

*Primary Examiner*—Paul Gensler

*Attorney, Agent, or Firm*—Willian Brinks Hofer Gilson & Lione

[57] ABSTRACT

An electromagnetic radiation converter for receiving and converting microwave signals having a circular or linear polarization. The converter comprises a waveguide for transmitting both circularly and linearly polarized signals, and a first mode transducer for converting the vertical component of the microwave signal into a corresponding signal on a microstrip line, a second mode transducer for converting the horizontal component of the microwave signal into a corresponding signal on a microstrip line, and means for combining the outputs of the first and second transducers. When receiving a circularly polarized signal, the combination means adjusts the phase of the vertical and horizontal components of a circularly polarized signal such that the phase of the vertical and horizontal components are equal prior to being combined so as to produce a signal equivalent to the circularly polarized signal originally received.

12 Claims, 3 Drawing Sheets

ELECTROMAGNETIC RADIATION CONVERTER

FIELD OF THE INVENTION

This invention relates to an apparatus for the reception and conversion of electromagnetic radiation having either a circular or linear polarization.

BACKGROUND OF THE INVENTION

Recently, in addition to the use of broadcast satellites, communication satellites are being utilized for the transmission of broadcast information. Such satellites transmit information in the form of electromagnetic radiation, hereinafter referred to as microwave signals. Furthermore, these satellites transmit microwave signals which are polarized in various directions.

The direction of polarization is defined as the direction of the electric field vector of the microwave signal. Microwave signals can be linearly polarized in either the horizontal or vertical direction, or circularly polarized. Circular polarization can be considered the combination of two linearly polarized signals of the same frequency, travelling in the same direction, having the same amplitude, which are 90° out of phase from one another. Circular polarization can be further classified as either right-handed or left-handed polarization. The aforementioned satellites transmit microwave signals having both linear and circular polarization.

Accordingly, it is desirable for a microwave signal receiver to be capable of receiving microwave signals comprising any of the various polarizations. Heretofore, prior art receivers were capable of receiving either linearly polarized microwave signals or circularly polarized microwave signals. However, as explained below, such devices required complicated and expensive circuitry to accomplish this task.

For example, one prior art receiver capable of receiving both vertically and horizontally polarized microwave signals comprises a converter having a first rod antenna positioned in a cylindrical waveguide so as to receive vertically polarized microwaves and a second rod antenna positioned in the cylindrical waveguide so as to receive horizontally polarized microwaves. Each antenna is electrically coupled to an amplifier which amplifies the output of the respective antenna. The outputs of the amplifier are electrically coupled to a frequency converter or mixer which converts the microwave signal to a lower frequency (i.e. intermediate frequency). This converter does not provide means for receiving circularly polarized microwaves.

In an example of a prior art receiver capable of receiving microwave signals having both linear and circular polarization, the receiver includes a converter comprising a dielectric plate for transforming circularly polarized microwave signals into linearly polarized microwave signals, a ferrite polarizer for rotating the direction of the linearly polarized signals (i.e. between vertical and horizontal), and a mode transducer for receiving the linearly polarized signals. These elements are disposed in series in a cylindrical waveguide which is designed to amplify the output of the mode transducer and convert these signals to an intermediate frequency.

In operation, as signals having various polarizations traverse the cylindrical waveguide, the signals are first incident on the dielectric plate. The dielectric plate, which has a length equal to $\frac{1}{4}$ the wavelength of the circularly polarized signal to be received, converts the circularly polarized signal to a linearly polarized signal. Signals originally having linear polarization are not affected by the dielectric plate. The signals are thereafter incident on the ferrite polarizer which functions to transform the signals, which are all linearly polarized, to either a horizontal or vertical polarization. The uniformly polarized signals are then received by the mode transducer, for example, a rod antenna positioned so as to receive the uniformly polarized signals. The antenna output is amplified and then converted to an intermediate frequency.

While this prior art receiver is capable of receiving signals having circular and linear polarizations, the construction thereof is both complex and expensive. More specifically, the ferrite polarizer must vary the angle of rotation for each linearly polarized signal so that each signal has as polarization corresponding to the polarization of the mode transducer. As the incoming linearly polarized signals can have any angle of polarization with respect to the mode transducer, the magnetic field generating circuit within the ferrite polarizer necessarily becomes a complex device.

Accordingly, there exists a present need for an electromagnetic radiation converter capable of converting either linearly or circularly polarized microwave signals to an intermediate frequency, which has a simplified design as compared to the prior art converters described above.

SUMMARY OF THE INVENTION

According to this invention, an electromagnetic radiation converter for receiving and converting microwave signals having either circular or linear polarization is provided. The converter comprises a waveguide for receiving and transmitting circularly or linearly polarized signals and a first and second mode transducer for converting the vertical and horizontal components of such signals to a corresponding signal on microwave strip line. The converter further comprises means for combining the outputs of the first and second mode transducers. When receiving a circularly polarized signal, the combining means adjusts the phase difference between the horizontal and vertical components of the circularly polarized signal such that the signals output by the first and second mode transducers are in phase prior to being combined. As a result, the combination of the signals produces a signal equivalent to the circularly polarized signal initially received. When receiving a horizontally or vertically polarized signal only the amplifiers electrically coupled with the mode transducer associated with the selected polarization are activated so that only signals having the selected polarization are output by the combining means.

As pointed out in greater detail below, the electromagnetic radiation converter of the present invention provides important advantages over the converters of the prior art. Specifically, the present invention substantially reduces the complexity of the design of converters heretofore known which are capable of receiving both circularly and linearly polarized microwave signals. For example, the present invention eliminates the need for a circulator, which is found in many prior art converters.

The invention itself, together with further objects and attendant advantages, will best be understood by reference to the following detailed description, taken in conjunction with the accompanying drawings.

DETAILED DESCRIPTION OF THE DRAWINGS

Figure 1:
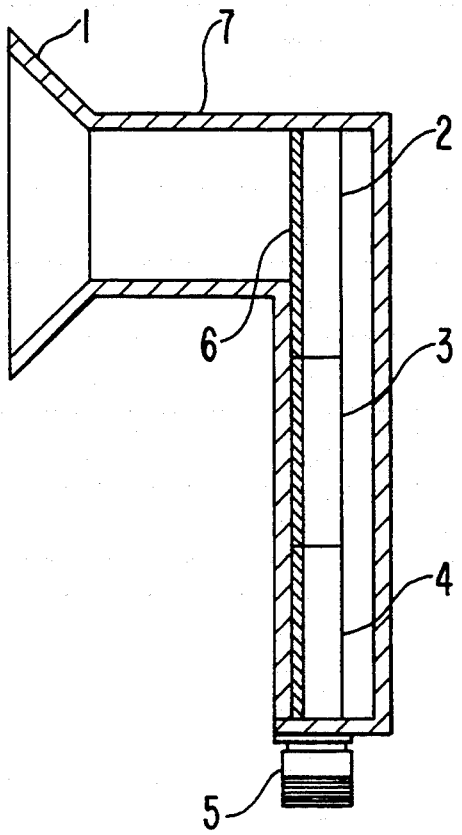
FIG. 1 is a plan view illustrating the structure of a first embodiment of the electromagnetic radiation converter of the present invention.

Turning now to the drawings, FIG. 1 is plan view illustrating the structure of a first embodiment of the electromagnetic radiation converter of the present invention. As shown in FIG. 1, the electromagnetic radiation converter, hereinafter referred to as a converter, comprises a primary collector 1 for efficiently collecting the microwave signals reflected by a reflector unit (not shown). The microwave signals are transmitted to a low noise amplifying unit 2 via a cylindrical waveguide 7 which couples the primary collector 1 to the low noise amplifying unit 2. The cylindrical waveguide 7 operates as a transmission line directing both circularly and linearly polarized microwave signals in the direction of the low noise amplifying unit 2.

The converter further comprises a frequency conversion circuit 3 for converting the microwave signals to an intermediate frequency, an intermediate frequency amplifying circuit 4, and connector 5.

The low noise amplifying unit 2 comprises separate mode transducers for receiving horizontally and vertically polarized microwave signals, microstrip lines and amplifiers, all of which are disposed on a dielectric substrate 6. A first side of the dielectric substrate 6 comprises strip conductors forming mode transducers and microstrip lines. The strip conductors and microstrip lines are formed from conductive materials, such as Cu and Ag—Pd. The opposite side of the dielectric substrate 6 is covered with a base conductor for forming the strip lines. Furthermore, portions of the base conductor are removed to form windows so as to allow the microwave signal, which is first incident on the base conductor side of the dielectric substrate 6, to be received by the mode transducers 21, 22.

Figure 2:
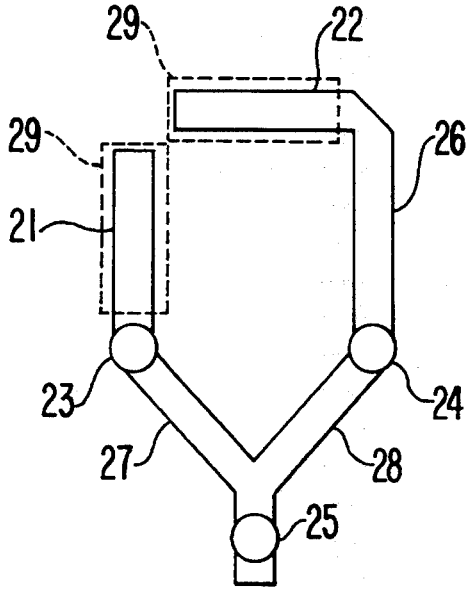
FIG. 2 is a plan view of a low noise amplifying unit comprising mode transducers and amplifiers for receiving microwave signals having left-handed circular polarization, horizontal polarization or vertical polarization, which is utilized in the first embodiment of the present invention.

FIG. 2 illustrates the structure of the low noise amplifying unit 2 comprising mode transducers 21, 22, amplifiers 23, 24, 25 and microstrip lines 26, 27, 28. Each amplifier 23, 24, 25 preferably comprises a low noise transistor. The low noise amplifying unit 2 detects and converts microwave signals having left-handed circular polarization, horizontal polarization or vertical polarization. The low noise amplifying unit 2 shown in FIG. 2 can be utilized in the first embodiment of the present invention.

More specifically, referring to FIG. 2, a first mode transducer 21 is positioned so as to receive vertically polarized microwave signals, and a second mode transducer 22, which is perpendicularly to the first mode transducer 21, receives horizontally polarized microwave signals. Both mode transducers 21, 22 comprise strip conductors formed from microstrip lines. The base conductor on the opposite side of the dielectric substrate 6 adjacent the strip conductors forming the mode transducers 21, 22 is removed so as to form a lead-in window 29 for each mode transducer, thereby exposing the mode transducers 21, 22 to the signals propagating in the cylindrical waveguide 7.

The first mode transducer 21 is electrically coupled to a first amplifier 23 which amplifies the output of the first mode transducer 21. The output of the second mode transducer 22 is electrically coupled to a second amplifier 24 by means of a microstrip line 26. The outputs of the first and second amplifiers 23, 24 are electrically coupled to a third amplifier 25 by means of microstrip lines 27 and 28, respectively. The length of microstrip lines 27 and 28 are equal. The third amplifier 25 functions to amplify the composite signal produced by the combination of the outputs of the first and second amplifiers 23, 24.

In order for the low noise amplifying unit 2 illustrated in FIG. 2 to receive left-handed circularly polarized microwave signals, the length of the transmission line between the output of the second mode transducer 22 and the second amplifier 24 (i.e. the length of microstrip line 26) is selected to be $\frac{1}{4}$ of a wavelength greater than the length of the transmission line coupling the output of the first mode transducer 21 and the first amplifier 23, at the frequency of the left-handed circularly polarized microwave signal to be received.

The low noise amplifying unit 2 is positioned inside the cylindrical waveguide 7 vertically to the longitudinal axis of the waveguide such that the base conductor side of the dielectric substrate 6 is the side which the microwave signals are incident upon. Furthermore, the lengthwise direction of the first mode transducer 21 is aligned with the vertical plane of polarization of the cylindrical waveguide 7. The lengthwise direction of the second mode transducer 22 is aligned with the horizontal plane of polarization of the cylindrical waveguide 7.

The operation of the first embodiment of the electromagnetic radiation converter comprising the low noise amplifying unit 2 shown in FIG. 2 is as follows. As a left-handed circularly polarized microwave signal enters the converter through the primary collector 1, it propagates through the cylindrical waveguide 7 and is thereafter incident on the low noise amplifier unit 2. The left-handed circularly polarized signal comprises a vertically polarized signal component and a horizontally polarized signal component which are identical in amplitude, but are out of phase from one another. Specifically, the horizontal component leads the vertical component by 90°, or $\pi/2$ radians.

As a result, the vertically polarized signal component of the circularly polarized microwave signal to be detected enters the first mode transducer 21 through the associated lead-in window 29 on the dielectric substrate 6 and is converted into a corresponding signal on the associated microstrip line. Similarly, the horizontally polarized component of the circularly polarized signal enters the second mode transducer 22 through the associated lead-in window 29 and is converted into a corresponding signal on the associated microstrip line.

As previously stated, the phase of the signal corresponding to the horizontally polarized component leads the phase of the signal corresponding to the vertically polarized component by $\pi/2$ radians. However, because the length of the transmission line between the second mode transducer 22 and the associated low noise amplifier 24 is $\pi/2$ radians longer than the length of the transmission line between the first mode transducer 21 and the associated low noise amplifier 23 for the desired frequency, the vertically and horizontally polarized components are in phase at the input of the associated low noise amplifier 23, 24. Accordingly, the summation of the outputs of the first and second amplifiers 23, 24 produces a composite signal which is equivalent to the circularly polarized microwave signal. Thus, the circularly polarized microwave signal is received (i.e detected).

As shown in FIG. 2, the output of the first amplifier 23 (i.e. the vertical component of the circularly polarized signal) and the output of the second amplifier 24 (i.e. the horizontal component of the circularly polarized signal) are combined by the third amplifier 25. Furthermore, the microstrip line 27 connecting the output of the first amplifier 23 to a first input of the third amplifier 25 has the same transmission line length as the microstrip line connecting the output of the second amplifier 24 to a second input of the third amplifier 25 so that the vertical and horizontal components of the signal remain in phase.

Returning to FIG. 1, the composite signal output by the third amplifier 25 is electrically coupled to the frequency conversion circuit 3, and is down converted to an intermediate frequency. The down converted composite signal is then input to the intermediate frequency amplifying unit 4, and thereafter output to the connector 5.

The electromagnetic radiation converter described above with reference to FIGS. 1 and 2 can also be utilized to receive linearly polarized microwave signals having either horizontal or vertical polarization. More specifically, when either a horizontally polarized or vertically polarized microwave signal enters the primary radiator 1, the signal propagates through the cylindrical waveguide 7 and is thereafter incident on both the first mode transducer 21 and the second mode transducer 22, which are disposed on the dielectric substrate 6 of the low noise amplifying unit 2. Furthermore, as previously explained, a vertically polarized signal incident on the first mode transducer 21 is converted into a corresponding signal on microstrip line, and a horizontally polarized signal incident on the second mode transducer 22 is converted into a corresponding signal on microstrip line.

Accordingly, in order to receive and convert only vertically polarized signals, only the first amplifier 23 is turned on. The second amplifier 24, which is coupled to the mode transducer 22 for receiving horizontally polarized signals is turned off. As a result, only vertically polarized signals received by the first mode transducer 21 are amplified by the third transistor 25 and subsequently output at the connector 5.

Similarly, in order to receive and convert only horizontally polarized signals, only the second amplifier 24 is turned on. The first amplifier 23 is turned off. Accordingly, only horizontally polarized signals received by the second mode transducer 22 are amplified by the third transistor 25 and subsequently output at the connector 5.

Thus, the first embodiment of the present invention is capable of receiving and converting microwave signals having left-handed circular polarization, horizontal polarization or vertical polarization. In the second embodiment of the present invention, the low noise amplifying unit 2 of the first embodiment is modified so as to allow for the reception of microwave signals having right-handed circular polarization, horizontal polarization or vertical polarization.

The elements of the modified low noise amplifying unit 2 are the same as the low noise amplifying unit of the first embodiment, except that in the modified unit the length of the transmission line between the mode transducer 31 for receiving vertically polarized signals and the associated low noise amplifier 23 is $\pi/2$ radians longer than the length of the transmission line between the mode transducer 32 for receiving horizontally polarized signals and the associated low noise amplifier 24. The length of the transmission line associated with the mode transducer 31 is increased because in a right-handed circularly polarized signal, the phase of the vertical component of the signal leads the phase of the horizontal component by $\pi/2$ radians. Therefore, as in the first embodiment, the vertical and horizontal components of the signal to be received are in phase at the input to the third amplifier 25.

Figure 3:
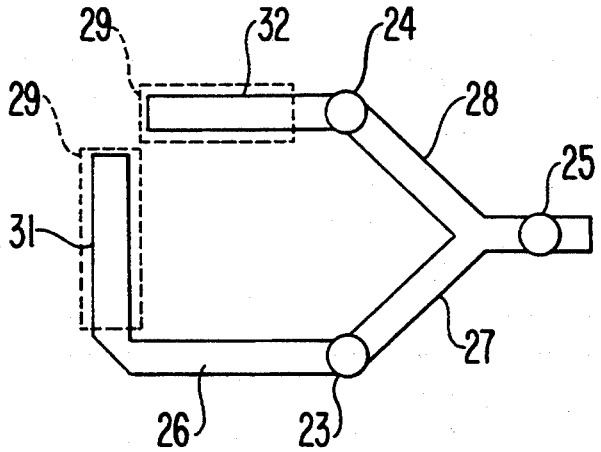
FIG. 3 is a plan view of a low noise amplifying unit comprising mode transducers and amplifiers for receiving microwave signals having right-handed circular polarization, horizontal polarization or vertical polarization, which is utilized in a second embodiment of the present invention.

More specifically, as shown in FIG. 3, the modified low noise amplifier unit 2 comprises a first mode transducer 31 for receiving vertically polarized microwave signals, and a second mode transducer 32 for receiving horizontally polarized microwave signals. As in the first embodiment, the mode transducers 31, 32 comprise strip conductors formed from microstrip lines, and are perpendicular to one another. The base conductor on the opposite side of the dielectric substrate 6 adjacent the strip conductors forming the mode transducers 31, 32 is removed so as to form a lead-in window 29 for each mode transducer, thereby exposing the mode transducers 31, 32 to the signals propagating in the cylindrical waveguide 7.

The length of transmission line between the first mode transducer 31 and the first amplifier 23 is adjusted to be $\pi/2$ radians longer than the length of the transmission line between the second mode transducer 32 and the second amplifier 24 at the frequency of the right-handed circularly polarized signal to be received.

The modified low noise amplifier unit 2 is disposed within the cylindrical waveguide 7 so as to be vertical with respect to the longitudinal axis of the cylindrical waveguide 7. Furthermore, the lengthwise direction of the first mode transducer 31 is aligned with the vertical plane of polarization of the cylindrical waveguide 7. The lengthwise direction of the second mode transducer 32 is aligned with the horizontal plane of polarization of the cylindrical waveguide 7.

The operation of the second embodiment of the electromagnetic radiation converter comprising the modified low noise amplifying unit 2 shown in FIG. 3 is as follows. As a right-handed circularly polarized microwave signal enters the converter through the primary collector 1, it propagates through the cylindrical waveguide 7 and is thereafter incident on the modified low noise amplifier unit 2. The right-handed circularly polarized signal comprises a vertically polarized signal component which leads the horizontally polarized signal component by $\pi/2$ radians.

The vertically polarized signal component of the circularly polarized signal enters the first mode transducer 31 through the associated lead-in window 29 and is converted into a corresponding signal on the microstrip line. Similarly, the horizontally polarized component of the circularly polarized signal enters the second mode transducer 32 through the associated lead-in window 29 and is converted into a corresponding signal on the microstrip line.

As previously stated, the phase of the signal corresponding to the vertically polarized component leads the phase of the signal corresponding to the horizontally polarized component by $\pi/2$ radians. However, because the length of the transmission line between the first mode transducer 31 and the associated low noise amplifier 23 is $\pi/2$ radians longer than the length of the transmission line between the second mode transducer 32 and the associated low noise amplifier 24 for the desired frequency, the vertically and horizontally polarized components are in phase at the inputs of the associated low noise amplifiers 23, 24. Accordingly, the summation of the outputs of the first and second amplifiers 23, 24 produces a composite signal which is equivalent to the right-handed circularly polarized microwave signal. Thus, the circularly polarized microwave signal is received (i.e detected).

As with the first embodiment, the output of the first amplifier 23 (i.e. the vertical component of the circularly polarized signal) and the output of the second amplifier 24 (i.e. the horizontal component of the circularly polarized signal) are combined by the third amplifier 25. Furthermore, the microstrip line 27 connecting the output of the amplifier 23 to the input of amplifier 25 has the same transmission line length as the microstrip line connecting the output of the amplifier 24 to the input of amplifier 25 so that the vertical and horizontal components of the signal remain in phase.

In order to receive a microwave signal having either a vertical or horizontal polarization, the modified low noise amplifier unit is operated in the same manner as the first embodiment of the present invention, as described above.

Figure 4:
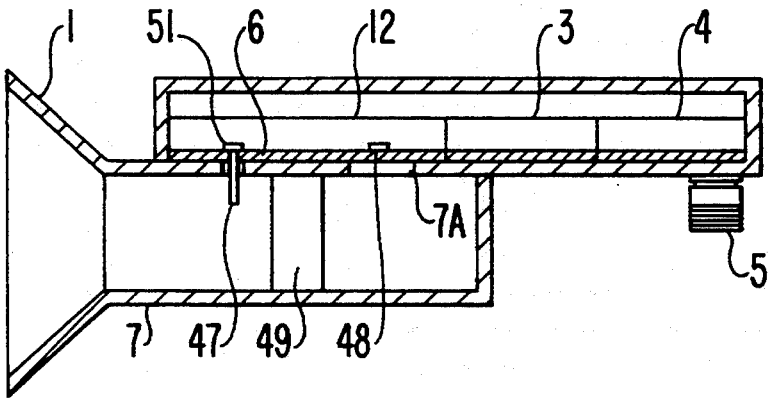
FIG. 4 is a plan view illustrating the structure of a third embodiment of the electromagnetic radiation converter of the present invention.

A third embodiment of the electromagnetic radiation converter which is capable of receiving microwave signals having left-handed circular polarization, horizontal polarization or vertical polarization is illustrated in FIG. 4. As shown in FIG. 4, the converter comprises a primary collector 1 for efficiently collecting the microwave signals reflected by a reflector (not shown). The microwave signals are transmitted to a low noise amplifying unit 12 via a cylindrical waveguide 7 which couples the primary collector 1 to the low noise amplifying unit 12. The converter also comprises a first and second mode transducer 47, 48 for converting the polarized signals in the cylindrical waveguide 7 into corresponding signals on microstrip lines disposed on a dielectric substrate 6.

The converter further comprises a frequency conversion circuit 3 for converting the microwave signal to an intermediate frequency, an intermediate frequency amplifying circuit 4, and connector 5.

The first mode transducer 47, which receives vertically polarized signals, comprises a first end connected to a microstrip line 51 formed on the dielectric substrate 6 of the low noise amplifying unit 12, and a second end which projects into the cylindrical waveguide 7. The first mode transducer 47 is positioned in the vertical plane of polarization of the cylindrical waveguide 7 so as to receive (i.e. detect) the vertical polarized signals. The first mode transducer 47 can be formed from copper or silver, as well as other types of metal.

The second mode transducer 48, which receives horizontally polarized signals, forms a portion of the low noise amplifying unit 12. The second mode transducer 48 is positioned above a slit *7a* provided in a wall of the cylindrical waveguide 7. The slit *7a* allows microwave signals to be incident on the second mode transducer 48. The distance between the first mode transducer 47 and the second mode transducer 48 is selected such that the length of the transmission line between the two mode transducers is $\pi/2$ radians (i.e., $\frac{1}{4}$ wavelength) for the frequency of the signal to be received.

The cylindrical waveguide 7 comprises a metal plate 49 positioned between the first mode transducer 47 and the slit *7a*. The metal plate 49 reflects vertically polarized signals so as to prevent the second mode transducer 48 from receiving vertically polarized signals. Thus, only horizontally polarized signals are incident on the second mode transducer 48.

Figure 5:
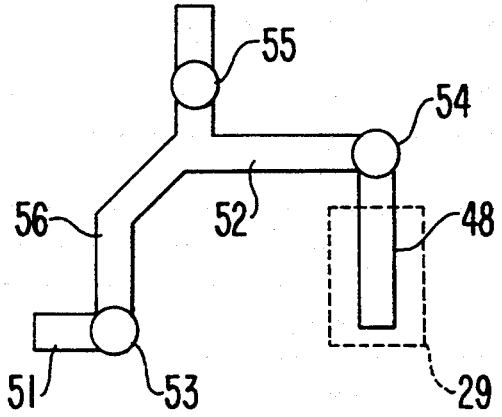
FIG. 5 is a plan view of a low noise amplifying unit comprising mode transducers and amplifiers for receiving microwave signals having a left-handed circular polarization, horizontal polarization or vertical polarization, which is utilized in the third embodiment of the present invention.

As shown in FIG. 5, the low noise amplifying unit 12 comprises the second mode transducer 48, a first and second amplifier 53, 54, a third amplifier 55 and microstrip lines 51, 52, 56, all of which are disposed on the dielectric substrate 6. Each amplifier 53, 54, 55 can comprise a single transistor.

More specifically, the second mode transducer 48 comprises a strip conductor formed from microstrip line, wherein the base conductor corresponding to the free end of the microstrip line is removed so as to form a lead-in window 29. The second mode transducer 48 is electrically coupled to the second amplifier 54, which amplifies the output of the second mode transducer 48. The output of the second amplifier is electrically coupled to the third amplifier 55 via microstrip line 52.

The dielectric substrate 6 is positioned horizontally with respect to the longitudinal axis of the cylindrical waveguide 7 such that the lengthwise direction of the second mode transducer 48 is aligned with the horizontal plane of polarization of the cylindrical waveguide 7.

The output of the first mode transducer 47 is electrically coupled to the first amplifier 53 via microstrip line 51. The output of first amplifier 53 is electrically coupled to the third amplifier 55 via microstrip line 56. The length of the transmission line between the output of first amplifier 53 and the third amplifier 55, and between the output of the second amplifier 54 and the third amplifier 55 are equal for the frequency of the signal to be received.

The operation of the third embodiment of the present invention is as follows. As a left-handed circularly polarized microwave signal enters the converter through the primary collector 1, it propagates through the cylindrical waveguide 7 and is first incident on the first mode transducer 47. The first mode transducer 47 converts the vertically polarized signal component of the circularly polarized signal into a corresponding signal on microstrip line 51. The microwave signal is next incident upon the metal plate 49 which is disposed vertically within the cylindrical waveguide 7. The metal plate 49 reflects the vertical component of the circularly polarized signal so as to utilize thoroughly the vertical component of the signal at the first mode transducer 47 (i.e. the metal plate 49 functions to increase the percentage of the vertical component of the signal incident on the first mode transducer 47). As a result, the first mode transducer 47 operates at a high efficiency level.

However, the metal plate 49 does not prevent the transmission of the horizontal component of the circularly polarized signal, which propagates through the metal plate 49 and is thereafter incident on the second mode transducer 48. The horizontal component of the circularly polarized signal passes through slit 7a and enters the second mode transducer 48 via the lead-in window 29 formed in the base conductor on the dielectric substrate 6 and is converted into a corresponding signal on the microstrip line. As previously stated, the horizontally polarized component of a left-handed circularly polarized signal leads the vertically polarized component by $\pi/2$ radians. However, because the first and second mode transducers are separated by a transmission length equal to a $\frac{1}{4}$ of a wavelength, the horizontal component of the signal must propagate an additional $\frac{1}{4}$ of a wavelength (i.e., $\pi/2$ radians) before being received by the second mode transducer 48. As a result, the horizontal component is delayed by $\pi/2$ radians, and therefore the vertical and horizontal components of the signal are in phase as the components enter the first and second amplifiers 53, 54, respectively.

Accordingly, the summation of the outputs of the first and second amplifiers 53, 54 produces a composite signal which is equivalent to the circularly polarized microwave signal. Thus, the circularly polarized microwave signal is received (i.e detected).

As shown in FIG. 5, the output of the first amplifier 53 and the output of the second amplifier 54 are combined by the third amplifier 55. The microstrip line 56 connecting the output of the first amplifier 53 to a first input of the third amplifier 55 has the same transmission line length as the microstrip line 52 connecting the output of the second amplifier 54 to a second input of amplifier 55 so that the vertical and horizontal components of the signal remain in phase.

Returning to FIG. 4, the composite signal output by the third amplifier 55 is electrically coupled to the frequency conversion circuit 3, and is down converted to an intermediate frequency. The down converted composite signal is then input to the intermediate frequency amplifying unit 4, and thereafter output to the connector 5.

In the same manner as the first and second embodiments of the present invention, the third embodiment can be operated so as to receive microwave signals having either a horizontal or vertical polarization. Specifically, in order to receive and convert only vertically polarized signals, only the first amplifier 53 is turned on. The second amplifier 54 is turned off. As a result, only vertically polarized signals received by the first mode transducer 47 are amplified by the third transistor 55 and subsequently output at the connector 5.

Similarly, in order to receive and convert only horizontally polarized signals, only the second amplifier 54 is turned on. The first amplifier 53 is turned off. Accordingly, only horizontally polarized signals received by the second mode transducer 48 are amplified by the third transistor 55 and subsequently output at the connector 5.

Thus, the third embodiment of the present invention is capable of receiving microwave signals having left-handed circular polarization, horizontal polarization or vertical polarization.

Figure 6:
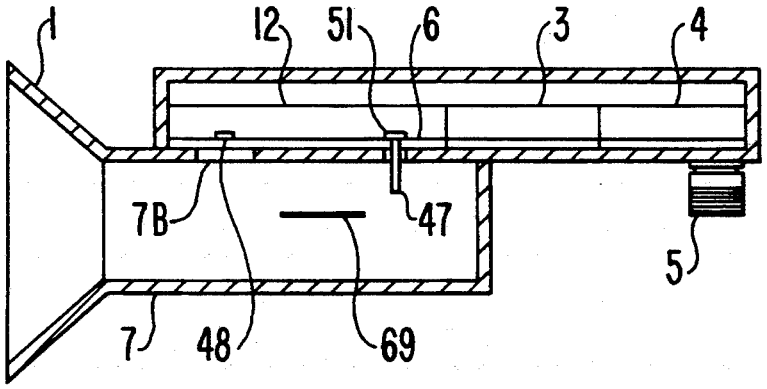
FIG. 6 is a plan view illustrating the structure of a fourth embodiment of the electromagnetic radiation converter of the present invention.

FIG. 6 illustrates a fourth embodiment of the present invention, wherein the converter described in the third embodiment is modified so as to allow for the reception of microwave signals having right-handed circular polarization, horizontal polarization or vertical polarization.

Referring to FIG. 6, the elements forming the converter of the fourth embodiment are essentially the same as the elements described above with regard to the third embodiment. The difference between the two embodiments is that in the fourth embodiment the mode transducer 48 for receiving the horizontal component of the circularly polarized signal is positioned $\frac{1}{4}$ of a wavelength in front of the mode transducer 47 for receiving the vertical component of the signal for the frequency of the signal to be received. The positions of the two mode transducers are reversed because in a right-handed circularly polarized signal, the phase of the vertical component of the signal leads the phase of the horizontal component by $\pi/2$ radians. By positioning the mode transducer 48 for the horizontal component $\frac{1}{4}$ of a wavelength ahead of the mode transducer 47 for the vertical component, the horizontal and vertical components of the signal are in phase at the outputs of the mode transducers 47, 48.

More specifically, as shown in FIG. 6, the converter comprises a primary collector 1 for efficiently collecting the microwave signals reflected by a reflector (not shown). The microwave signals are transmitted to a low noise amplifying unit 12 via a cylindrical waveguide 7 which couples the primary collector 1 to the low noise amplifying unit 12. The converter further comprises a frequency conversion circuit 3 for converting the microwave signal to an intermediate frequency, an intermediate frequency amplifying circuit 4, and connector 5.

The low noise amplifier unit 12 of the fourth embodiment is functionally equivalent to the low noise amplifier unit 12 of the third embodiment. However, as explained above, the second mode transducer 48 is positioned $\frac{1}{4}$ of a wavelength in front of the first mode transducer 47. The second mode transducer 48 is positioned above a slit **7*b* provided in a wall of the cylindrical waveguide 7. The slit 7*b* allows microwave signals to be incident on the second mode transducer 48. In addition, the metal plate 49 of the third embodiment is replaced by a metal plate 69** which reflects the horizontal component of circularly polarized signals. In all other aspects the fourth embodiment of the present invention operates in the same manner as the third embodiment.

In order to receive a microwave signal having either a vertical or horizontal polarization, the modified low noise amplifier unit 12 is operated in the same manner as the third embodiment of the present invention, as described above.

Variations of the aforementioned embodiments are also possible. For example, while a cylindrical waveguide is described in the embodiments, any waveguide capable of transmitting circularly and linearly polarized signals can be used. One such example is an elliptical waveguide.

In another variation of the present invention, the means of compensating for the phase difference between the vertical and horizontal components of a circularly polarized signal which are disclosed in the first and third embodiments are combined. Specifically, the phase difference is partially compensated for by the difference in the length of the microstrip lines connecting the first and second amplifiers to the third amplifier, and partially by positioning the first and second mode transducers at different locations in the waveguide.

Of course, it should be understood that a wide range of changes and modifications can be made to the preferred embodiments described above. It is therefore intended that the foregoing detailed description be regarded as illustrative rather than limiting, and that it be understood that it is the following claims, including all equivalents, which are intended to define the scope of this invention.

What is claimed is:

1. An electromagnetic radiation converter for receiving and converting microwave signals having circular or linear polarization, said converter comprising;

a waveguide for receiving said microwave signals, said waveguide capable of transmitting circularly or linearly polarized signals;

a first mode transducer for receiving and converting vertically polarized microwave signals propagating in said waveguide into a corresponding signal on microwave strip line;

a second mode transducer for receiving and converting horizontally polarized microwave signals propagating in said waveguide into a corresponding signal on microwave strip line; and means for combining the outputs of said first and second mode transducers, wherein said combining means adjusts the phase difference between the horizontal and vertical components of a circularly polarized signal such that the horizontal and vertical components are in phase prior to being combined; said combining means being controllable so as to transmit the output of the first or second mode transducer, said combining means comprising a first amplifier electrically coupled to the output of said first mode transducer by a first microstrip line, a second amplifier electrically coupled to the output of said second mode transducer by a second microstrip line and a third amplifier having an input which is electrically coupled to the outputs of the first and second amplifiers, respectively, via a third and fourth microstrip line, wherein the length of the first and second microstrip lines are adjusted such that the signals output by the first and second mode transducers are in phase at the inputs of the first and second amplifiers.

2. The electromagnetic radiation converter of claim 1, wherein the transmission length of said second microstrip line is greater than the transmission length of said first microstrip line by $\frac{1}{4}$ of a wavelength at the frequency of the signal to be received so as to receive signals having left-handed circular polarization.

3. The electromagnetic radiation converter of claim 1, wherein the transmission length of said first microstrip line is greater than the transmission length of said second microstrip line by $\frac{1}{4}$ of a wavelength at the frequency of the signal to be received so as to receive signals having right-handed circular polarization.

4. The electromagnetic radiation converter of claim 1 further comprising a frequency converter electrically coupled to the output of said third amplifier so as to reduce the frequency of the signal output by the third amplifier.

5. The electromagnetic radiation converter of claim 1, wherein said first amplifier, said second amplifier and said third amplifier comprise a transistor.

6. The electromagnetic radiation converter of claim 3, further comprising means for activating said first amplifier and deactivating said second amplifier, wherein said converter receives and converts vertically polarized microwave signals.

7. The electromagnetic radiation converter of claim 3, further comprising means for activating said second amplifier and deactivating said first amplifier, wherein said converter receives and converts horizontally polarized microwave signals.

8. An electromagnetic radiation converter for receiving and converting microwave signals having circular or linear polarization, said converter comprising;

a waveguide for receiving said microwave signals, said waveguide capable of transmitting circularly or linearly polarized signals;

a first mode transducer for receiving and converting vertically polarized microwave signals into a corresponding signal on microwave strip line, said first mode transducer disposed in said waveguide;

a second mode transducer for receiving and converting horizontally polarized microwave signals into a corresponding signal on microwave strip line, said second mode transducer disposed adjacent said waveguide and positioned above a slit in a wall of said waveguide so as to receive horizontally polarized microwave signals; and means for combining the outputs of said first and second mode transducers, said combining means being controllable so as to transmit the output of the first or second mode transducer;

wherein said first and second mode transducers are positioned in said waveguide such that the horizontal and vertical components of a circularly polarized signal are in phase at the outputs of said first and second mode transducers.

9. The electromagnetic radiation converter of claim 8, wherein said second mode transducer is positioned $\frac{1}{4}$ of a wavelength behind said first mode transducer for the frequency of the signal to be received such that the horizontal and vertical components of a left-handed circularly polarized signal are in phase at the outputs of said first and second mode transducers.

10. The electromagnetic radiation converter of claim 9 further comprising a metal plate disposed in said waveguide between said first and second mode transducers; said plate reflects vertically polarized signals so as to prevent such signals from being incident on said second mode transducer.

11. The electromagnetic radiation converter of claim 8, wherein said first mode transducer is positioned $\frac{1}{4}$ of a wavelength behind said second mode transducer for the frequency of the signal to be received such that the horizontal and vertical components of a right-handed circularly polarized signal are in phase at the outputs of said first and second mode transducers.

12. The electromagnetic radiation converter of claim 11 further comprising a metal plate disposed in said waveguide between said first and second mode transducers; said plate reflects horizontally polarized signals so as to prevent such signals from being incident on said first mode transducer.

* * * * *